US008152291B2

(12) United States Patent
Greinwald

(10) Patent No.: US 8,152,291 B2
(45) Date of Patent: Apr. 10, 2012

(54) DEVICE FOR PRINTING TWO-DIMENSIONAL PARTS, PARTICULARLY PLASTIC CARDS

(75) Inventor: Kurt Greinwald, Überlingen (DE)

(73) Assignee: Atlantic Zeiser GmbH, Emmingen (DE)

( * ) Notice: Subject to any disclaimer, the term of this patent is extended or adjusted under 35 U.S.C. 154(b) by 444 days.

(21) Appl. No.: 12/444,813

(22) PCT Filed: Oct. 25, 2007

(86) PCT No.: PCT/DE2007/001913

§ 371 (c)(1), (2), (4) Date: Apr. 8, 2009

(87) PCT Pub. No.: WO2008/055466

PCT Pub. Date: May 15, 2008

(65) Prior Publication Data

US 2010/0118094 A1 May 13, 2010

(30) Foreign Application Priority Data

Nov. 3, 2006 (DE) ..... 10 2006 052 302

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS

| | | | | |
|---|---|---|---|---|
| 4,767,116 | A | 8/1988 | Eberle | |
| 5,865,115 | A * | 2/1999 | Fassler et al. | 101/177 |
| 5,967,510 | A | 10/1999 | Ono et al. | |
| 6,045,278 | A | 4/2000 | Kubatzki et al. | |
| 6,296,339 | B1 | 10/2001 | Geserich et al. | |
| 6,357,867 | B1 * | 3/2002 | Hine | 347/89 |
| 6,792,329 | B2 * | 9/2004 | Adams et al. | 700/133 |
| 6,891,555 | B2 * | 5/2005 | Minowa et al. | 347/171 |
| 6,971,647 | B2 | 12/2005 | Jewell et al. | |
| 2001/0024228 | A1 | 9/2001 | Klinefelter et al. | |
| 2002/0018097 | A1 | 2/2002 | Kitahara et al. | |
| 2004/0017456 | A1 | 1/2004 | Obertegger et al. | |
| 2004/0061759 | A1 * | 4/2004 | Szlucha | 347/102 |
| 2005/0098054 | A1 | 5/2005 | Berndtsson et al. | |
| 2005/0195261 | A1 * | 9/2005 | Stelter et al. | 347/102 |

FOREIGN PATENT DOCUMENTS

| | | |
|---|---|---|
| DE | 1241647 | 6/1967 |
| DE | 19545058 | 3/1997 |
| DE | 102005012990 | 9/2006 |
| EP | 1 153 859 | 11/2001 |
| FR | 2742693 | 6/1997 |
| GB | 2 372 234 | 8/2002 |
| JP | 10236700 | 9/1998 |
| WO | WO 86/06329 | 11/1986 |

OTHER PUBLICATIONS

International Preliminary Report on Patentability and Written Opinion of the International Searching Authority for International Application No. PCT/DE2007/001913.

International Search Report for International Application No. PCT/DE2007/001913.

* cited by examiner

*Primary Examiner* — Stephen Meier
*Assistant Examiner* — Alexander C Witkowski
(74) *Attorney, Agent, or Firm* — Alston & Bird LLP

(57) ABSTRACT

A device for printing two-dimensional parts, particularly plastic substrates, preferably plastic cards, having a depot comprising the parts to be imprinted, a printing station with a printing device, and a transport device for transporting the parts through the printing station, characterized in that aligning means serving the alignment of the parts on the transport device are provided in front of the printing station.

15 Claims, 3 Drawing Sheets

DEVICE FOR PRINTING TWO-DIMENSIONAL PARTS, PARTICULARLY PLASTIC CARDS

BACKGROUND OF THE INVENTION

The present invention relates to a device for printing two-dimensional parts, particularly plastic substrates, preferably plastic cards, which device comprises a depot containing the parts to be printed, a printing station comprising a printing device, and a transport device for transporting the parts through the printing station.

The present invention basically relates to the printing of any desired substrate, which can include so-called plastic cards, for example. For this purpose, mention can be made, merely by way of example, of bankcards, credit cards, identification cards, cards serving for access authorization, etc.

The printing of plastic cards involves certain problems to the extent that the cards have to be conveyed and printed at a high speed in the production process. Maximum speeds of 0.4 msec are thus achieved in the entire process, as a result of which up to 6,000 parts or cards can be printed per hour.

Solutions known so far from practical experience, in which conventional printers are used for printing cards or the like, involve considerable problems with regard to the precision required in continuous printing. The parts or substrates to be printed can thus be positioned only with insufficient precision in front of the printing station. High fluctuations occur in the speed of the conveying device when transporting the parts. Furthermore, the respective position of the part cannot be detected to a sufficient extent or with sufficient speed.

It is therefore the object underlying the present invention to design and improve a device for printing two-dimensional parts, particularly plastic substrates, preferably plastic cards, in such a way that the cards can be printed properly, while being positioned accurately during the printing process, at a sufficiently high conveying and printing speed. In particular, this should also allow for a situation such as multi-color printing, which requires different print modules to print accurately positioned parts, even multiple times in a superposed manner, namely to create secondary colors.

BRIEF SUMMARY OF VARIOUS EMBODIMENTS

In accordance with the features of Claim 1, the device according to the invention is characterized in that aligning means serving for aligning the parts on the transport device are provided in front of the printing station.

It has been established according to the invention that a positioning problem occurs regularly before feeding the card into the actual printing station. The problem of inaccurate positioning can occur when the cards are being transferred from a depot onto the transport device or during transfer from a feeding path, which is defined between a depot and the printing device, and can comprise a feeder belt for example. In this case, the part to be printed is transferred twice as a result of which positional inaccuracies occur each time.

It has been established according to the invention that the flaw involving inaccurate positioning of the part to be printed can be eliminated by providing special aligning means in front of the printing station, i.e. aligning means, which serve for aligning the parts on the transport device. Should the parts be positioned exactly on the transport device, it is essential to hold these parts in the exact position and to subject them to the individual printing processes in the ongoing production process.

It is basically feasible to provide the parts to be printed by means of a depot, which can be disposed directly in front of the transport device. In such a case, the parts can be transferred from the depot directly to the transport device, preferably by means of a manipulator, so that the parts arrive from there into the printing station. The aligning means act on the parts in front of the printing station so that the latter are moved through the printing station while being positioned exactly.

It is likewise feasible to provide a special feeding path comprising a corresponding feeding device between the depot or a loading point and the transport device used for transporting the parts through the printing station. In such a case, the parts are transferred from the depot to the feeding device, likewise preferably by means of a manipulator or another transfer device. The feeding device conveys the parts to the transport device, and the parts are transferred there once again, namely directly onto or to the transport device. The transfer can occur in such a way that the parts are pushed by the feeding device directly onto the transport device. The means required for sliding the parts onto the transport device can be assigned to the feeding device, transport device or a special transfer device.

The feeding device serving for conveying the parts from the depot to the conveyor equipment is advantageously formed as a feeder belt, and the feeding device can comprise a lower and an upper band. In the case of such a design of the feeder belt, the parts would be conveyed between the two cooperating belts—by the movement of the two belts—to the transfer station on the transport device. The two belts can, in turn, be formed by belts or the like, each of which extends in a parallel manner, so that each part or each card is conveyed by two lower and two upper line contacts with the belts.

As mentioned already above, aligning means can be disposed in front of the printing station, specifically in the region of an aligning path formed in front of the printing station. This aligning path can comprise a type of a ramp, on which the parts are pushed by the feeding device and positioned there. Mechanical guide elements, which are equipped with a corresponding in-feed aid and form a type of centering channel for the respective part, are suitable for the related positioning. In this connection, it is essential that the aligning path extend to in front of the printing station, and preferably, from the end of the feeding device to just in front of the inlet into the printing station.

The aligning means act particularly advantageously on the parts to be printed transversely to their conveying direction. Accordingly, the parts can be positioned or aligned transversely to the conveying direction in which the aligning means act on the parts with a force-fit and/or a form-fit. A combination of force-fitting and form-fitting action is of particular advantage, that is to say, to the effect that the parts are moved by way of movable aligning means against stationary aligning means and are at least slightly pressed in doing so, as a result of which the parts are forced to align themselves precisely.

In concrete terms, the aligning means comprise a lateral guide strip across at least a part of the aligning path, and this lateral guide strip can also be easily divided into several individual strips. The part to be printed is conveyed along the guide strip, the result of which is a very precise positioning of the part when it rests against the guide strip. The guide strip extends advantageously from the end of the feeding device parallel to the transport device up to just in front of the printing station. This ensures a type of form-fitting alignment of the part.

In most cases, the provision of a guide strip serving for alignment is not enough by itself since the parts do not readily rest against the lateral guide strip. It is advantageous in this respect if the aligning means comprise a positioning device preferably on the side located opposite to the guide strip or also a positioning device acting from above. This positioning device presses the parts at least slightly against the guide strip. Concretely put, the positioning device comprises positioning means that move with the parts in the conveying direction. These positioning means can be formed as a preferably resilient belt. The belt is looped around rollers disposed at either end thereof and therefore runs continuously.

In concrete terms, the belt could run over the parts, as a result of which the parts are conveyed such that they are accurately positioned on the transport device. The parts can be aligned and positioned so to speak in the course of this conveying process.

In a particularly advantageous manner, the belt is tilted by 90° opposite to the transport device and therefore runs next to the transport device parallel to the latter in a region in front of the printing station, namely across the aligning path defined above.

In addition to being used for the actual positioning of the parts, the belt can serve for accurately positioned conveying of the parts, specifically from the feeding device or the transfer position there to the transport device and across the region of the aligning path. For this purpose, the belt comprises conveying elements, preferably in the form of integral conveying cams, which push the respective part onto the transport device and position it precisely on the transport device across the aligning path, specifically by applying at least slight pressure against the guide strip. It should be pointed out at this point that the parts can be conveyed, particularly in the region between the feeding device or the feeder belt and the transport device or the transport belt in other ways with or without the simultaneous positioning of the respective part.

Alternatively to the embodiment described above, it is feasible for the feeder belt to push the respective part directly onto the transport device, and to likewise provide the transport device with conveying elements, for example, conveying cams, which grasp the part and convey it further. An adhesive coupling of the part to the surface of the transport belt is likewise feasible.

It has already been mentioned above that the transport device comprises a precise conveyor belt. This conveyor belt is advantageously designed as a low-stretch belt. It is likewise advantageous for the belt to be made of steel.

Particularly with respect to a uniform conveying speed, it is advantageous if the conveyor belt works in a non-slip manner and preferably comprises a positive drive for this purpose. It is likewise possible to provide the conveyor belt with a restricted guidance of the actual belt body. The provision of lateral guide strips for the belt body is likewise advantageous and the thrust faces of the guide strips can be formed with a curved shape so that frictional forces can be reduced to a minimum.

Furthermore, the conveyor belt is advantageously equipped with a rotary transducer, which is disposed selectively on the drive shaft or deflection shaft or on the surface of the conveyor belt. The precision of such a measuring system is one increment per μm.

Furthermore it is advantageous if the conveyor belt has a low-reflection surface, in particular a surface, which absorbs UV light so that the main portion of the UV radiation used for pressure fusing is absorbed and not reflected, for instance, by the wall surface.

Furthermore, bleed off printing is advantageous for completely printing the parts or the substrates.

According to the above embodiments, the part is positioned across the aligning path and the part is already located on the transport device or the conveyor belt during this alignment. If the part is aligned with high precision, it is then essential to hold the part in its exact position on the conveyor belt. For this purpose, the conveyor belt comprises special holding means for holding the parts such that they are positioned accurately. However, these holding means may fully take effect only when the part has overcome the aligning path and is thereafter aligned with accurate positioning on the conveyor belt.

The holding means can be formed in various ways. It is thus feasible, for example, for the holding means to act adhesively by providing the conveyor belt with an appropriate coating. Thus, for example, it is conceivable to provide a type of rubber coating similar to foam rubber on the surface of the conveyor belt. It is likewise feasible to create a moisture film on the surface of the conveyor belt. The moisture film causes the two-dimensional part to properly stick to the surface of the conveyor belt.

The holding means act particularly advantageously using low pressure. Accordingly, the holding means are formed as a suction system integrated into the conveyor belt. In other words, the conveyor belt is, in such a case, a suction belt, to which the positioned parts adhere positioned accurately for being transported further, particularly for being transported through the printing station.

It has been pointed out above that the holding means at best act to a lesser extent in the region of the aligning path so that the parts can be easily aligned on the conveyor belt using low forces. It is thus advantageous to generate a lower suction pressure across the aligning path than in the region of the printing station. For this purpose, the suction pressure could increase gradually across the conveying path. In doing so, this pressure or low pressure must be strongest in the region of the printing device or the printing station so that the parts are held in their accurate positions there.

Moreover, a sensor device is advantageously provided in front of the printing station for detecting the part arriving there. This sensor device can be a detector for detecting a leading edge of the part or substrate. It is likewise feasible to detect the entire contour of the part by means of a type of image recognition, as a result of which it is possible to clearly determine whether an exact positioning of the part has been achieved. Should the part not be positioned exactly, the part would have to be repositioned or the printing process would not be activated for this part.

The printing device can basically be any printing device, which is suitable for printing card substrates. In concrete terms, it is a printing device, which operates using inkjet technology. Here, the printing device comprises a four-color printing system, which in turn can comprise eight print modules disposed in a row. If two print modules are provided for each primary color (CMYK), a sufficiently good and rapid printing is possible.

A fusing unit, which can be a UV freezing unit, is further advantageously provided after each print module.

Furthermore, it is advantageous if a special UV coating machine is disposed downstream of the printing device for the final coating of the printed part. As a result, the part or substrate can be provided with a protective coating, which includes the printing that has already been effected. This additional printing device can be disposed downstream of the previously mentioned print modules in the form of an integrated or independent function unit.

The entire printing device can be disposed in a housing or under a hood. In a particularly advantageous manner, the printing device and, if appropriate, the UV coating machine can be positioned vertically, on one hand for the purpose of adjustment and on the other for releasing the transport device for purposes of inspection, maintenance, repairs etc.

An additional transfer point is provided at the end of the transport device. It is possible to transfer the part from here to or onto an additional transport device. It is likewise feasible for the printed parts to fall from here into a collecting receiver or to remove or transfer them in another way.

There are various possibilities of configuring and improving the teaching of the present invention to advantage. For this purpose, reference should be made on the one hand to the claims subordinate to Claim 1 and on the other to the following description of an exemplary embodiment of the invention with the help of the drawings. Generally preferred embodiments and developments of the teaching are also explained in conjunction with the description of the preferred exemplary embodiment of the invention with reference to the drawings, in which

DETAILED DESCRIPTION

Figure 1:
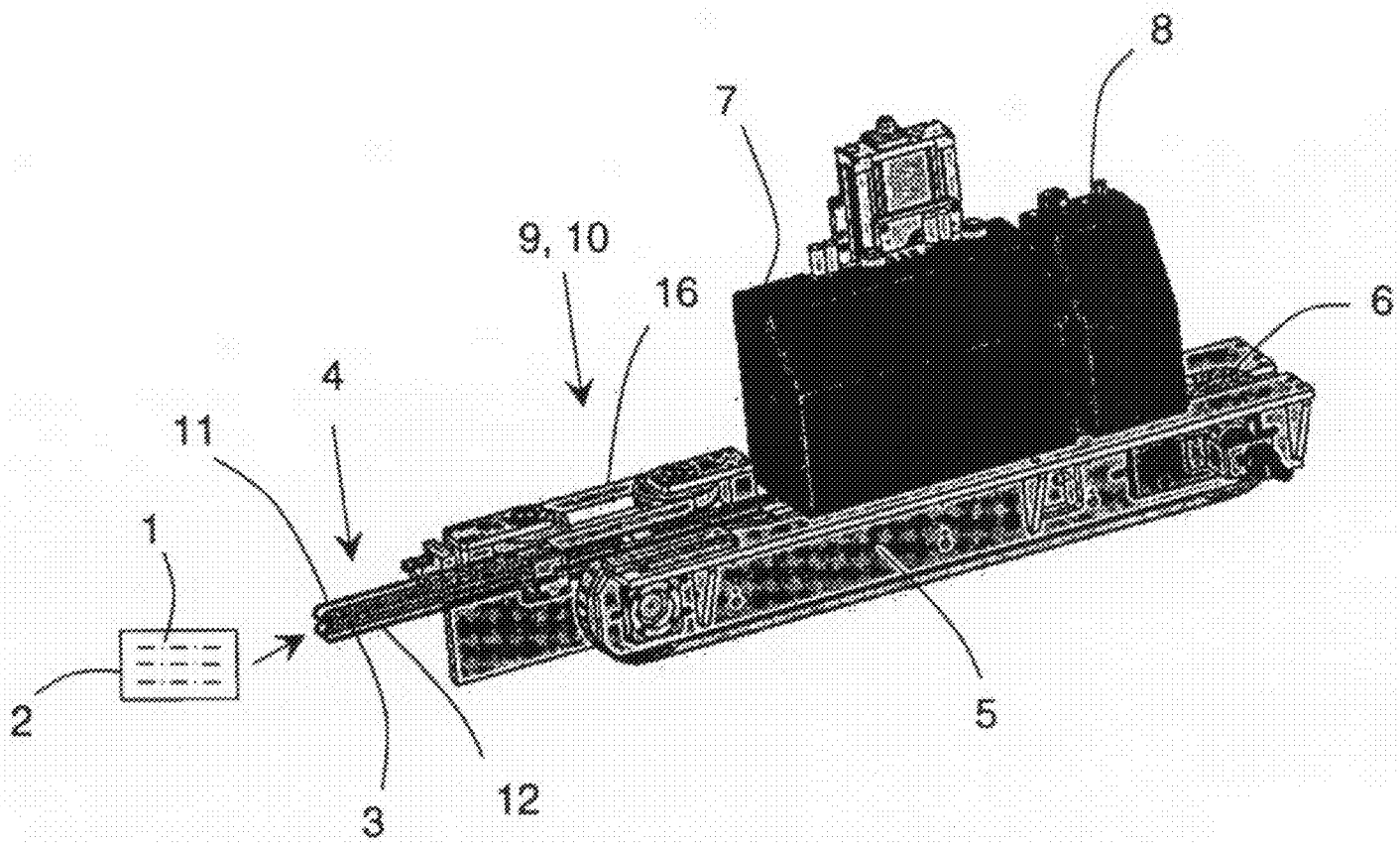
FIG. 1 is a schematic view of an exemplary embodiment of a device according to the invention for printing two-dimensional parts.

FIG. 1 shows an exemplary embodiment of a device according to the invention for printing two-dimensional parts 1, which, in concrete terms, is a device used for printing so-called plastic cards.

Cards 1 shown merely symbolically in FIG. 1 are provided by way of a depot 2. They arrive over a feeding path 4 comprising a feeder belt 3 onto a transport device 5 comprising a conveyor belt 6.

The transport device 5 and the conveyor belt 6 serve for transporting the cards 1 transferred by the feeder belt 3 through the printing station 7, to which a painting station 8 is attached. The printing station 7 and the painting station 8 are disposed such that they can be adjusted in height and/or positioned vertically.

In the manner suggested by the invention, aligning means 9, which serve for aligning the parts 1 on the conveyor belt 6, are provided in front of the printing station 7. The region in which the aligning means 9 act, is referred to hereinafter as the aligning path 10.

Figure 2:
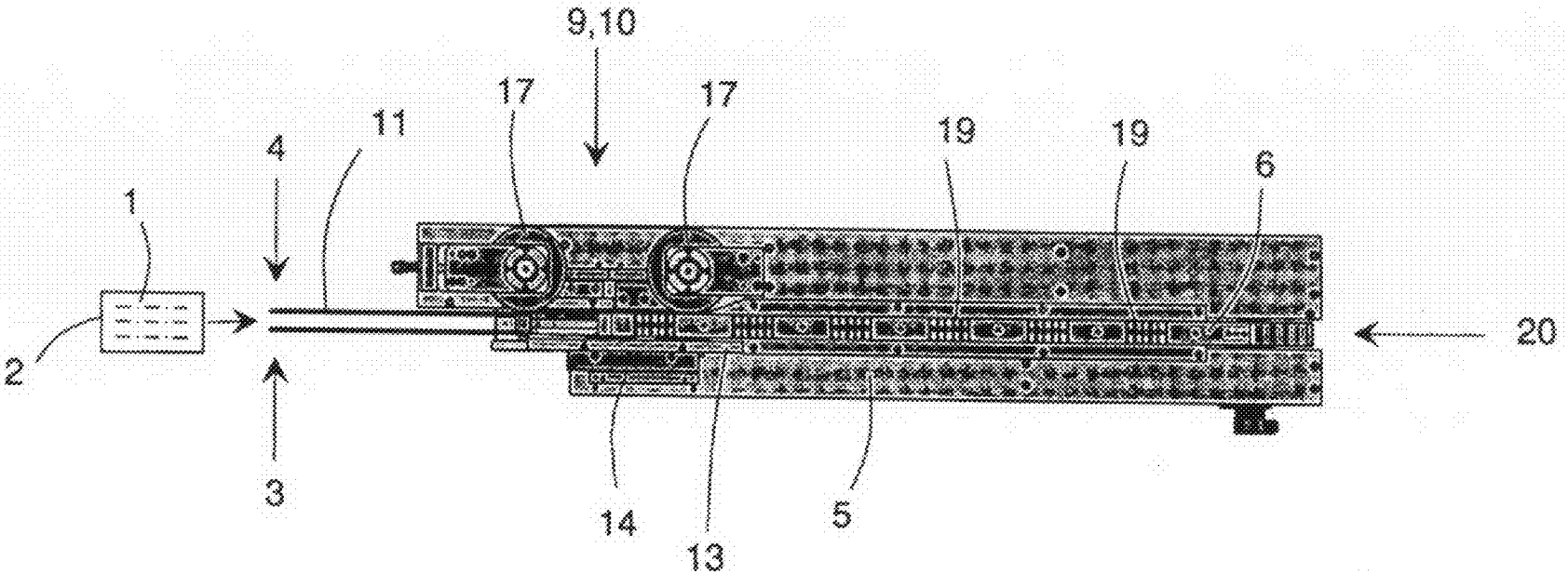
FIG. 2 is a schematic plan view of the device shown in FIG. 1, but without a printing device.

FIG. 2 is a plan view of the device shown in FIG. 1, but without the printing station 7.

Figure 3:
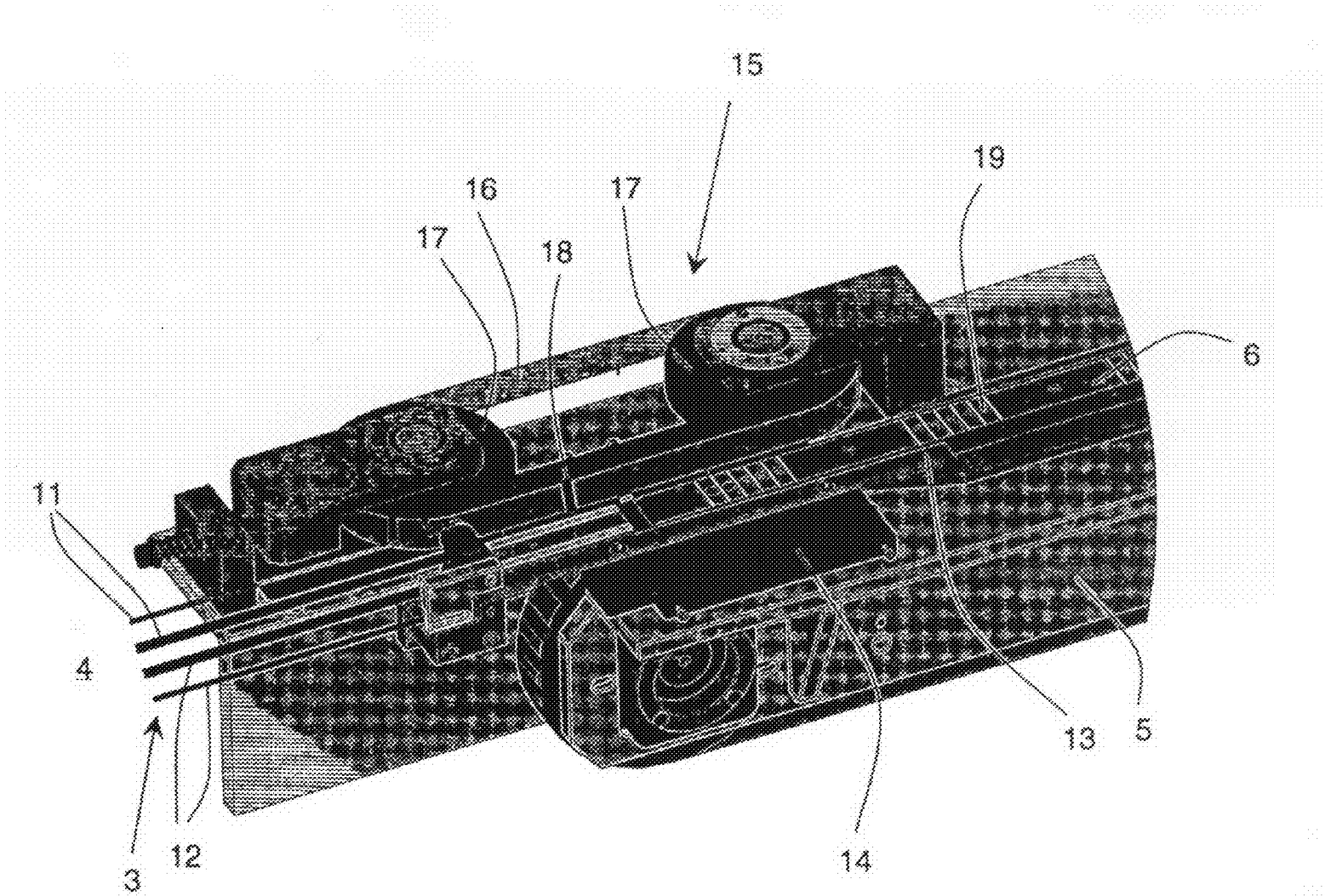
FIG. 3 is an enlarged, partial view of the region of the aligning path comprising the aligning means of the device shown in FIG. 1.

FIG. 3 shows, in detail, the aligning path 10, in the course of which the cards 1 are aligned on the conveyor belt 6 before they arrive at the printing station 7, illustrated only in FIG. 1, and are conveyed through the same.

FIG. 3 shows, in part, the feeder belt 3, which conveys the cards 1 across the feeding path 4. In concrete terms, the feeder belt 3 comprises two complementary belts, which are formed of belts 11, 12 in pairs. The parts or cards 1 are conveyed in the region located between the belts 11, 12.

At the end of the feeding path 4, the cards 1 are transferred to the conveyor belt 6 in the region of the aligning path 10. From there, the cards 1 arrive at the printing station 7 comprising the printing device.

The aligning means 9 are disposed in the region of an aligning path 10 formed in front of the printing station 7, said aligning means 9 acting on the cards 1 transversely to their conveying direction. The aligning means act on the cards with a force-fit and a form-fit.

FIG. 3 clearly shows that the aligning means 9 comprise a lateral guide strip 13 extending across the aligning path 10, and the card 1 is conveyed along the guide strip 13. The guide strip 13 can be adjusted precisely using adjusting means 14.

A positioning device 15 is provided on the side located opposite to the guide strip 13, said positioning device 15 pressing the cards 1 at least slightly against the guide strip 13. Concretely put, the positioning device 15 comprises positioning means that move in the conveying direction of the cards 1, said positioning means being formed particularly as a resilient belt 16, which is looped around rollers 17 disposed at either end thereof and thus runs continuously. The belt 16 is tilted by 90° opposite to the transport device 5 and thus runs next to the transport device 5 in a region in front of the printing station 7. The belt 16 serves for conveying the cards 1 such that the latter are positioned accurately, for which purpose the belt 16 comprises integral conveying cams 18, which push the respective card 1 onto the transport device 5 or the conveyor belt 6.

The conveyor belt 6 is designed as a low-stretch belt and is therefore made of steel. It works in a non-slip manner, that is to say, with the help of a positive drive.

FIG. 3 further shows that the conveyor belt 6 is formed as a suction belt, that is to say, it comprises holding means operating using low pressure. More precisely, the conveyor belt comprises an integrated suction system, which serves for drawing the cards by suction such that they are positioned accurately and thus for holding the cards 1. The generation of the suction pressure is configured in such a way that the latter increases across the conveying path, thus enabling easy alignment of the parts 1 at the start of the conveying path, specifically in the region of the aligning means 9. After the alignment, the increased suction pressure causes the cards 1 to be positioned firmly across the entire transport path, in particular through the region of the printing station 7.

The suction system is symbolized by openings 19 in the conveyor belt 6, and the low pressure is generated by means of openings 19 from below the conveyor belt 6.

At the end of the transport device 5, an end-side transfer point 20 is present, from which the finished cards 1 can optionally be transferred to an additional transport system or put into storage.

With regard to the features, which cannot be inferred from the Figures, the general part of the description is incorporated for preventing repetition. Finally, it should be pointed out here that the exemplary embodiment described above merely serves for explaining the teaching claimed by way of example, without restricting said teaching to this embodiment.

The invention claimed is:

1. A device for printing two-dimensional parts, particularly plastic substrates such as plastic cards, said device comprising:

a depot containing the parts to be printed; a printing station comprising a printing device; and a transport device for transporting the parts through the printing station, wherein aligning means serving for aligning the parts on the transport device are provided in front of the printing station, wherein the aligning means comprise a lateral guide strip across at least a part of the aligning path, and the part is conveyed along the guide strip, wherein the aligning means comprise a positioning device, which positioning device presses the parts at least slightly against the guide strip, wherein the positioning device can comprise positioning means that move with the parts in the conveying direction, wherein the positioning means are formed as a preferably resilient belt, which is looped around rollers disposed at either end thereof and runs continuously, and wherein the belt runs next to the transport device in a region in front of the printing station such that the belt is tilted by 90° opposite to the transport device.

2. The device according to claim 1, wherein the depot is disposed directly in front of the transport device so that the parts can be transferred from the depot to the transport device preferably by means of a manipulator.

3. The device according to claim 1, wherein a feeding path with a feeding device is provided between the depot and the transport device so that the parts can be transferred from the depot to the feeding device and from the feeding device to the transport device preferably by means of a manipulator, wherein the feeding device can be formed as a feeder belt and/or wherein the feeding device can comprise a lower and an upper band and that the parts can be conveyed between the two cooperating bands, and wherein the two bands can be formed by belts or the like, each of which extends in a parallel manner.

4. The device according to claim 1, wherein the aligning means act in the region of an aligning path formed in front of the printing station and/or wherein the aligning means act on the parts transversely to their conveying direction and/or wherein the aligning means act on the parts with a force-fit and/or a form-fit.

5. The device according to claim 1, wherein the guide strip extends from the end of the feeding device parallel to the transport device up to in front of the printing station.

6. The device according to claim 1, wherein the positioning device is located on the side opposite to the guide strip, and wherein the belt runs over the parts and conveys the parts such that the parts are accurately positioned on the transport device.

7. The device according to claim 6, wherein the belt serves for conveying the parts such that the latter are positioned accurately, wherein the belt can comprise conveying elements, preferably in the form of integral conveying cams, which push the respective part onto the transport device.

8. The device according to claim 1, wherein the transport device is formed as a precise conveyor belt, wherein the conveyor belt can be formed as a low-stretch belt and/or wherein the conveyor belt is made of steel.

9. The device according to claim 8, wherein the conveyor belt has a restricted guidance of the belt body and/or the conveyor belt is guided over lateral guide strips, wherein the thrust faces of the guide strips are formed with a curved shape.

10. The device according to claim 8, wherein the conveyor belt is equipped with a rotary transducer, wherein the rotary transducer is disposed on the drive shaft or deflection shaft or on the surface of the conveyor belt.

11. The device according to claim 8, wherein the conveyor belt has a low-reflection surface, in particular a surface which absorbs UV light.

12. The device according to claim 8, wherein the conveyor belt comprises holding means for holding the parts such that they are positioned accurately, wherein the holding means operate adhesively or using low pressure.

13. The device according to claim 12, wherein the holding means are formed as a suction system integrated into the conveyor belt, wherein a lower suction pressure can be generated across the aligning path than in the region of the printing station and/or wherein the suction pressure can increase across the conveying path.

14. The device according to claim 1, wherein the printing device comprises a four-color printing system, wherein the printing device comprises eight print modules disposed in a row, wherein two print modules can be provided for each of four primary colors (CMYK), wherein a fusing unit, in particular a UV freezing unit can be provided after each print module, wherein a UV coating machine can be disposed downstream of the printing device for the final coating of the part, wherein the printing device can be disposed in a housing or under a hood and/or wherein the printing device and, if appropriate, the UV coating machine can be positioned vertically.

15. The device according to claim 1, wherein a transfer point can be defined at the end of the transport device, wherein the transfer point serves for transferring the parts to an additional transport device or into a collecting receiver or the like.

* * * * *